United States Patent [19]

Sugiyama

[11] Patent Number: 5,044,802

[45] Date of Patent: Sep. 3, 1991

[54] PRINTING APPARATUS HAVING AN ERASER FOR ERASING A PRINTED CHARACTER

[75] Inventor: Noriyuki Sugiyama, Tokyo, Japan

[73] Assignee: Canon Kabushiki Kaisha, Tokyo, Japan

[21] Appl. No.: 632,642

[22] Filed: Dec. 26, 1990

Related U.S. Application Data

[63] Continuation of Ser. No. 7/401,637, Aug. 31, 1989, abandoned.

[30] Foreign Application Priority Data

Aug. 31, 1988 [JP] Japan ..... 63-217867

[51] Int. Cl.[5] ..... B41J 29/00

[52] U.S. Cl. ..... 400/695; 400/697; 400/697.1

[58] Field of Search ..... 400/695, 696, 697, 697.1

[56] References Cited

U.S. PATENT DOCUMENTS 4,374,626 2/1983 Hooker ..... 400/696

4,810,121 3/1989 Ueno et al. ..... 400/697.1

4,834,567 5/1989 Ueno ..... 400/697.1

FOREIGN PATENT DOCUMENTS 0294578 12/1987 Japan ..... 400/697

0092475 4/1988 Japan ..... 400/695

*Primary Examiner*—Edgar S. Burr

*Assistant Examiner*—C. Bennett

*Attorney, Agent, or Firm*—Fitzpatrick, Cella, Harper & Scinto

[57] ABSTRACT

A printing apparatus including a print mechanism for printing key-input print information; an eraser for erasing a character or symbol printed on a recording medium with the print mechanism; a first memory for storing the key-input information; a second memory for storing information on a print object erased with the eraser; and an erasure controller for controlling the eraser in accordance with a comparison result between the erased object information stored in the second memory and the key-input information stored in the first memory.

31 Claims, 20 Drawing Sheets

FIG. 3B

| | |
|---|---|
| 22a CODE NO. | 01 02 03 04 05 06 07 08 09 0A 0B 0C 0D 0E 10 11 12 13 14 15 16 17 18 19 1A 1B |
| 21a INPUT KEY | a b c d e f g h i j k l m n o p q r s t u v w x y z |
| 22b CODE NO. | 1C 1D 1E 1F 20 21 22 23 24 25 26 27 28 29 2A 2B 2C 2D 2E 30 31 32 33 34 35 36 |
| 21b INPUT KEY | A B C D E F G H I J K L M N O P Q R S T U V W X Y Z |

| |
|---|
| FIG. 6A |
| FIG. 6B |

| |
|---|
| FIG. 7A |
| FIG. 7B |

| |
|---|
| FIG. 8A |
| FIG. 8B |
| FIG. 8C |

| |
|---|
| FIG. 11A |
| FIG. 11B |

PRINTING APPARATUS HAVING AN ERASER FOR ERASING A PRINTED CHARACTER

This application is a continuation of application Ser. No. 401,637, filed Aug. 31, 1989, now abandoned.

BACKGROUND OF THE INVENTION

1. Field of the Invention

The present invention relates to a printing apparatus having an eraser for erasing a printed character.

2. Related Background Art

A printing apparatus such as an electronic typewriter is known, which has a correction device for erasing a character printed on a recording medium by painting it white with a correction tape or the like.

A conventional erasure operation for a character or symbol will be described with reference to FIGS. 9 and 10.

FIG. 9 is a flow chart illustrating a conventional print control procedure which includes steps 1 to 16.

Upon turning on the power, the procedure starts by initializing a counter and the like (step 1). After the initializing step, a print mode starts and the apparatus waits for a key input of print information (step 2). Upon a key input (step 3), the key-input information is stored in a print memory (step 4).

Next, it is checked if the oldest key-input data is stored in the print memory (step 5). If NO (step 6), the flow returns to step 5 to await a key-input. If YES, it is checked if the stored data affects the carrier position (step 7). If YES at step 7, the key data is printed (step 8) and the printed data is stored in an output memory (step 9).

Next, it is checked if the printed data is a character or symbol (step 10). If NO, the flow advances to step 13. If YES, it is checked if the printed data is for a superimposing character (step 11). If YES, the flow advances to step 13. If NO, the carrier is moved by one space in the print direction (step 12). The value of a position counter is increased or decreased by the amount corresponding to a displacement of the carrier (step 13).

Next, the oldest data stored in the print memory is erased, i.e., the printed character data is erased (step 14), and the flow returns to step 5.

If NO at step 7, it is checked if the key data is for an erasure key (step 15). If YES, the erasure mode processing shown in FIG. 11 starts. If NO, it is checked if key data is for a code key (step 16). If YES, the code mode processing is executed. If NO, the key-input instruction is executed and thereafter the flow advances to step 13.

FIG. 10 is a flow chart illustrating an example of the processing procedure in the erasure mode according to a conventional printing apparatus, the flow including steps 1 to 4.

It is checked if a character or symbol is stored in the output memory at the carrier position (step 1). If YES, a character or symbol at the carrier position is erased (step 2) and the flow returns to step 14 shown in FIG. 9. If NO, the carrier is moved backward to the position corresponding to the position nearest to a character or symbol stored in the output memory immediately before the present carrier position (step 3). The value of the position counter is decreased by the amount corresponding to a displacement of the carrier (step 4) and the flow returns to step 2.

FIG. 11 is a flow chart illustrating an example of the processing procedure in the manual erasure mode of a conventional printing apparatus, the flow including steps 1 to 18.

A key input is awaited (step 1). Upon a key input (step 2), the key-input information is stored in the print memory (step 3).

Next, it is checked if the oldest key-input data is stored in the print memory (step 4). If NO (step 5), the flow returns to step 4 to wait for a key-input. If YES, it is checked if the stored data is for a relocation key (step 6). If NO, it is checked if the stored data is for an erasure key (step 7). If YES at step 7, the oldest data stored in the print memory is erased (step 8). Thereafter, the oldest data stored in the print memory is checked (step 9). This data may be an erasure code or a character code.

Next, it is checked if the oldest key data is stored in the print memory (step 9). If NO (step 10), the flow returns to step 9. If YES, it is checked if the key information (key code) is for a character or symbol (step 11). If NO, the flow advances to step 13. If YES, the character or symbol is erased (step 12).

Next, the oldest data stored in the print memory is erased (step 13), and the flow returns to step 4.

If YES at step 6, a relocation code is outputted (step 14) to release the manual erasure mode, and the flow returns to step 13 shown in FIG. 9.

If NO at step 7, it is checked if the key data is for a back trace key (step 15). If NO, a key code process for the key data is executed (step 16). The value of the position counter is increased or decreased by the amount corresponding to a displacement of the carrier, and thereafter the flow returns to step 13.

If YES at step 15, a buzzer alarm is effected (step 18) and the flow returns to step 13.

As described above, according to a conventional printing apparatus, after a specific erasure operation for erasing a character or symbol at a certain position is carried out once in the erasure mode, the control immediately returns to the print mode.

In the manual erase mode, in order to erase a character or symbol, it is necessary to carry out a key-input operation two times, one for entering an erasure key and the other for entering a character or symbol to be erased.

In the automatic erasure operation following the control procedure shown in FIG. 9, immediately after executing a specific erasure operation for a character or symbol, the control immediately returns to the print mode. If the erasure performance of a correction tape deteriorates or if a slight displacement of a print sheet occurs during the erasure operation, the specific erasure operation carried out in a conventional printing apparatus becomes unsatisfactory in properly erasing a printed character or symbol.

Also in the manual erasure operation not storing information for a character or symbol to be erased, it is necessary to carry out a plurality of key input operations in order to erase one character or symbol. In addition, after the specific erasure operation, if the same character or symbol at the same position is required again to be erased, a plurality of key-input operations become necessary. The efficiency of the correction operation is therefore considerably lowered as the number of characters or symbols to be erased increases.

SUMMARY OF THE INVENTION

The present invention has been made to solve the above problems. It is an object of the present invention to provide a printing apparatus wherein in the automatic erasure mode or manual erasure mode, the erasure operation for a character or symbol at the same carrier position is continued so long as the same character or symbol is entered, to thus allow one to perfectly erase the character or symbol with a simple operator manipulation.

According to an aspect of the present invention, the printing apparatus comprises first storage means for storing key-input information; second storage means for storing information on a print object erased with an eraser; and erasure control means for controlling the eraser in accordance with a comparison result between the erased object information stored in the second storage means and the key-input information stored in the first storage means.

According to the printing apparatus of this invention, during the erasure mode effected upon a key input, the erased object information is held in storage in the second storage means. The erasure control means compares the key-input information stored in the first storage means with the erased object information. If they are coincident with each other, the erasure operation by the eraser is continued to perfectly erase the associated character or symbol.

BRIEF DESCRIPTION OF THE DRAWINGS

FIG. 38 shows the relationship between keys and key codes;

DETAILED DESCRIPTION OF THE PREFERRED EMBODIMENTS

Figure 1:
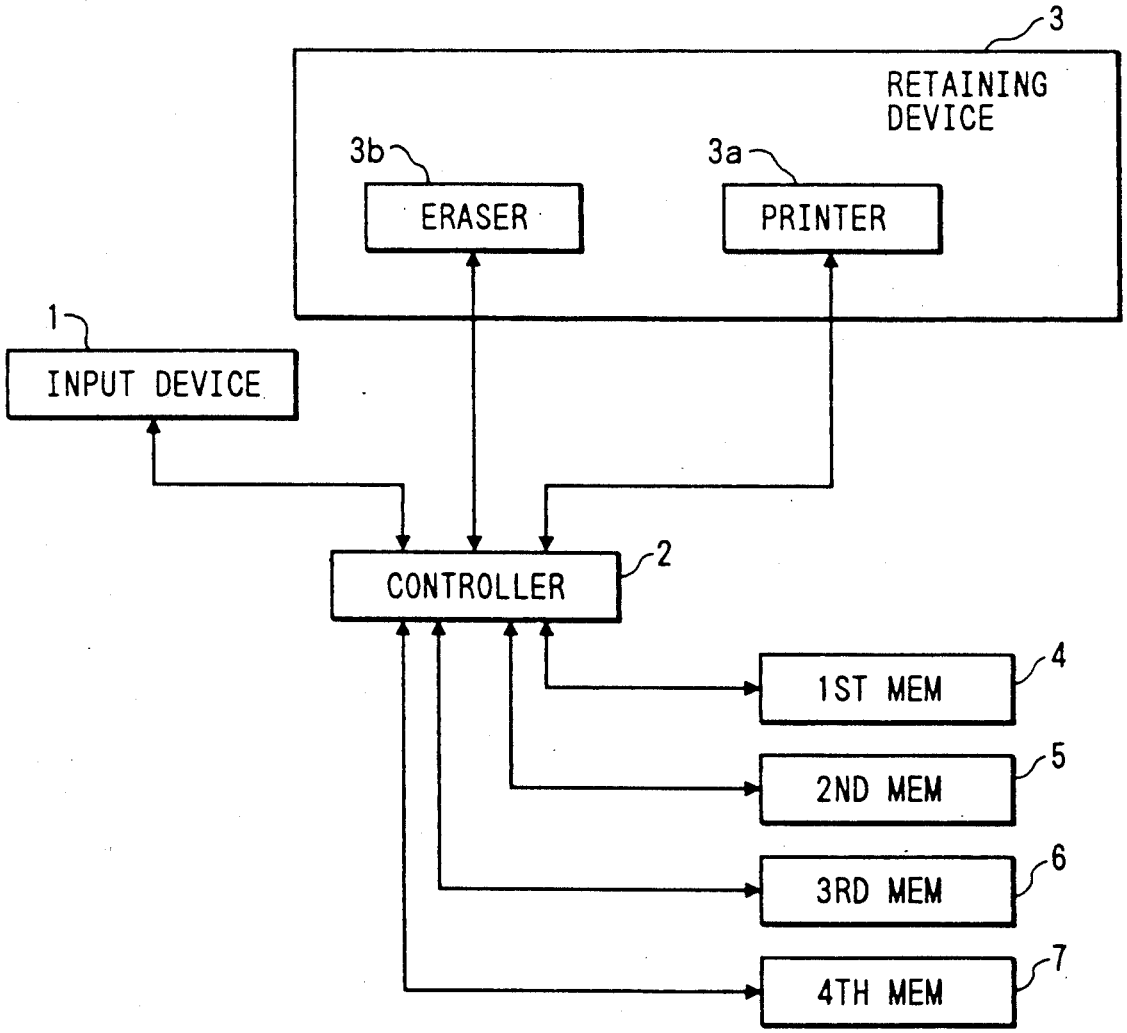
FIG. 1 is a block diagram showing the structure of a printing apparatus according to an embodiment of the present invention.

FIG. 1 is a block diagram showing the structure of a printing apparatus according to an embodiment of the present invention. Reference number 1 represents an input device such as a keyboard having various character keys, symbol keys, print control keys (such as an erasure key), all to be described later. Reference numeral 2 represents a controller (erasure control means) for controlling a retaining device 3 including a printer 3*a* and an eraser 3*b*, and for processing key-input information from the input device 1, in accordance with a control procedure to be described later.

Reference numeral 4 represents a first memory for storing key-input information from the input device 1. Reference numeral 6 represents a third memory for storing a character or symbol outputted to and printed with the printer 3*a*. Reference numeral 7 represents a fourth memory for storing the position of a character or symbol. Reference numeral 5 represents a second memory for storing the information on a print object erased, such as a character or symbol erased with the eraser 3*b*.

The controller 2 operates such that the information on a print object erased with the eraser is held in storage in the second memory 5 during the erasure mode, the key-input information stored in the first memory 4 is compared with the erasure object information, and if they are coincident with each other, the erase operation by the eraser 3*b* is continued to thus perfectly erase the associated character or symbol.

Figure 2:
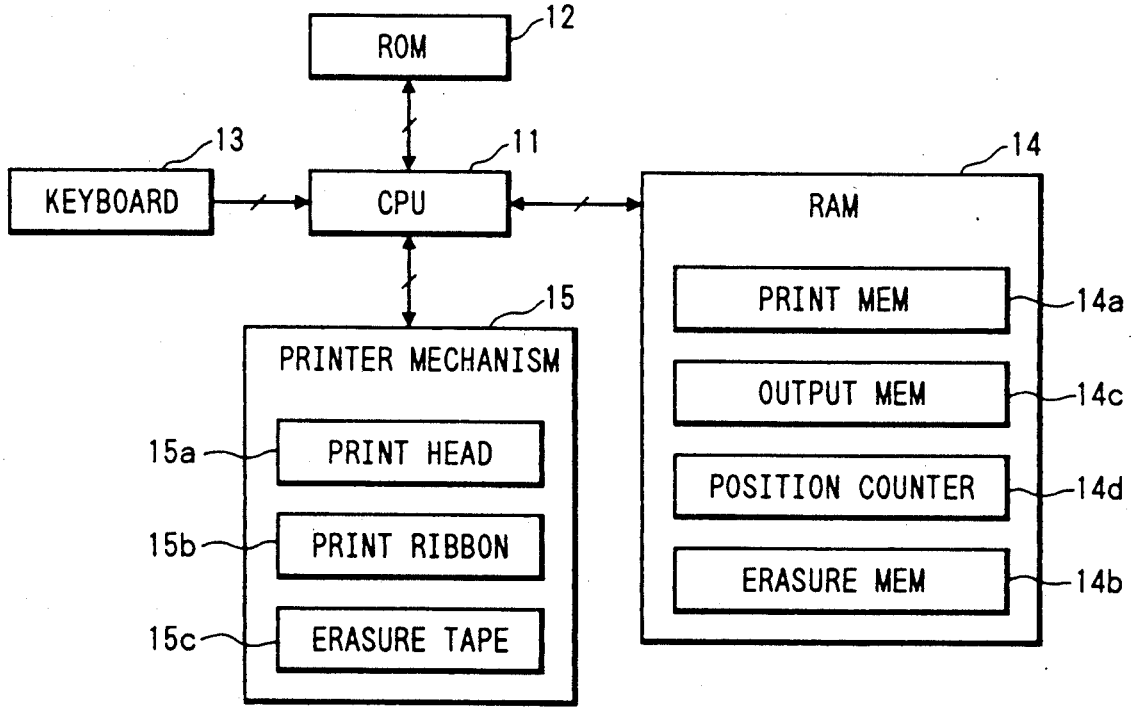
FIG. 2 is a block diagram showing the control system of an electronic typewriter embodying the printing apparatus of this invention.

FIG. 2 is a block diagram showing the structure of an electronic typewriter embodying the present invention. A CPU 11 controls a print operation and an erasure operation in accordance with the control programs (as shown in the flow charts of FIGS. 6 and 7 to be described later) stored in a ROM 12.

Figure 3A:
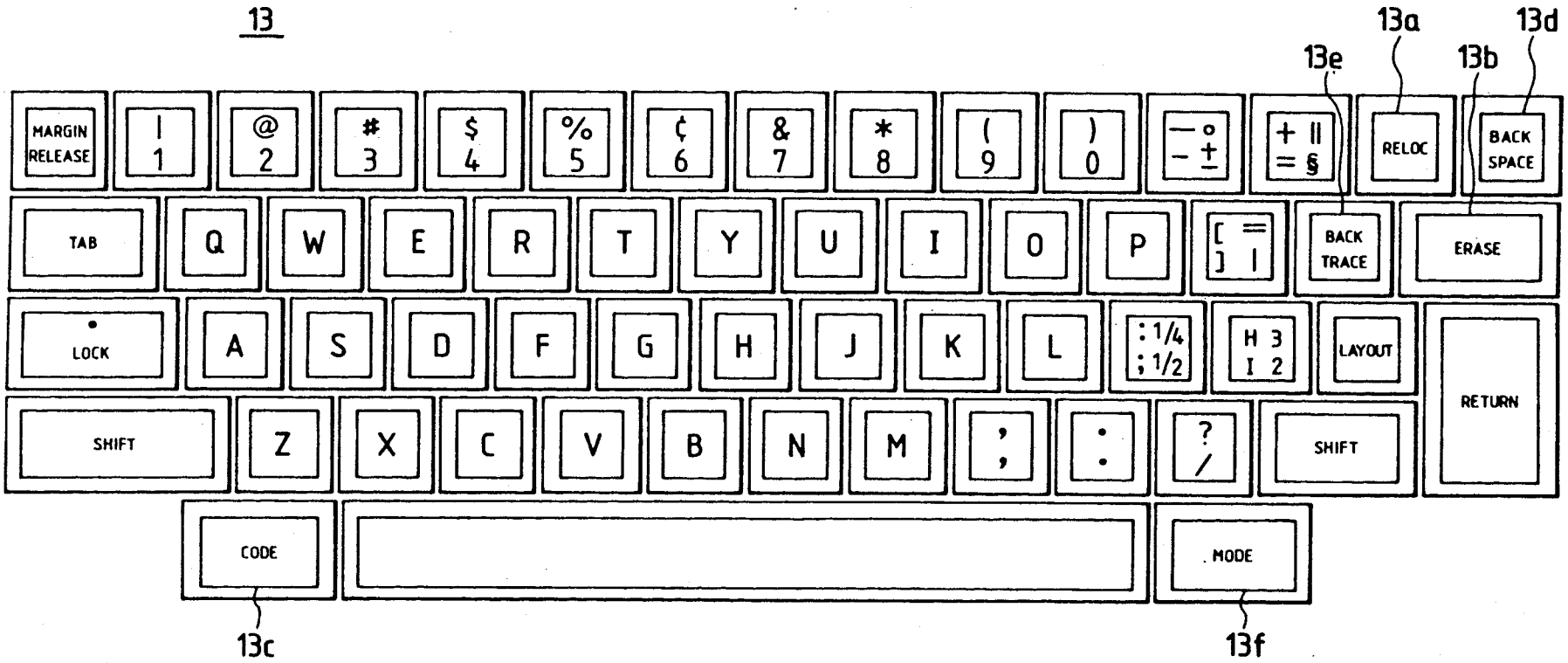
FIGS. 3A is a plan view showing the key arrangement of the keyboard shown in FIG. 2.

A keyboard 13 has a key arrangement as shown in FIG. 3A. The keys of the keyboard 13 include character keys and symbol keys for entering print information, control keys for entering print mode information, erasure mode information and information on other modes, and other keys. A random access memory (RAM) 14 includes a print memory 14*a* for storing key-input print information; an output memory 14*c* for storing outputted and printed out information; a position counter 14*d* for storing the position of outputted information; an erasure memory 14*b* for storing an erased character or symbol; and other storage devices. This RAM 14 operates as a working memory dynamically changing its contents during the operation of the apparatus. A printer mechanism 15 is constructed of a print head 15*a*, a print ribbon 15*b*, a correction tape 15*c* and the like. Upon input of an erasure command, the erasure tape 15*c* transfers its correction substance onto a character or symbol printed on a recording sheet at the carrier stop position.

FIG. 3A is a plan view showing the key arrangement of the keyboard 13 shown in FIG. 2. A relocation key 13*a* is depressed to restore an original print position after a character or symbol before the original print position is erased. If this key is depressed during the manual erasure mode, this mode is released. An erasure key and code key are indicated at 13*b* and 13*c*, respectively. A back space key 13*b* is depressed to move backward the carrier. A back trace key and mode key are indicated at 13*e* and 13*f*, respectively.

FIG. 3B illustrates the relationship between the keys of the keyboard 13 and their codes, for alphabet characters by way of example. Each input key 21*a*, 21*b* has its corresponding key code 22*a*, 22*b*. The codes 22*b* are for capital letters, whereas the codes 22*a* are for small letters.

Next, the processing in the automatic erasure mode of this invention will be described with reference to FIGS. 4A to 4C, FIGS. 5A and 5B, FIGS. 6 and 7.

Figure 4A:
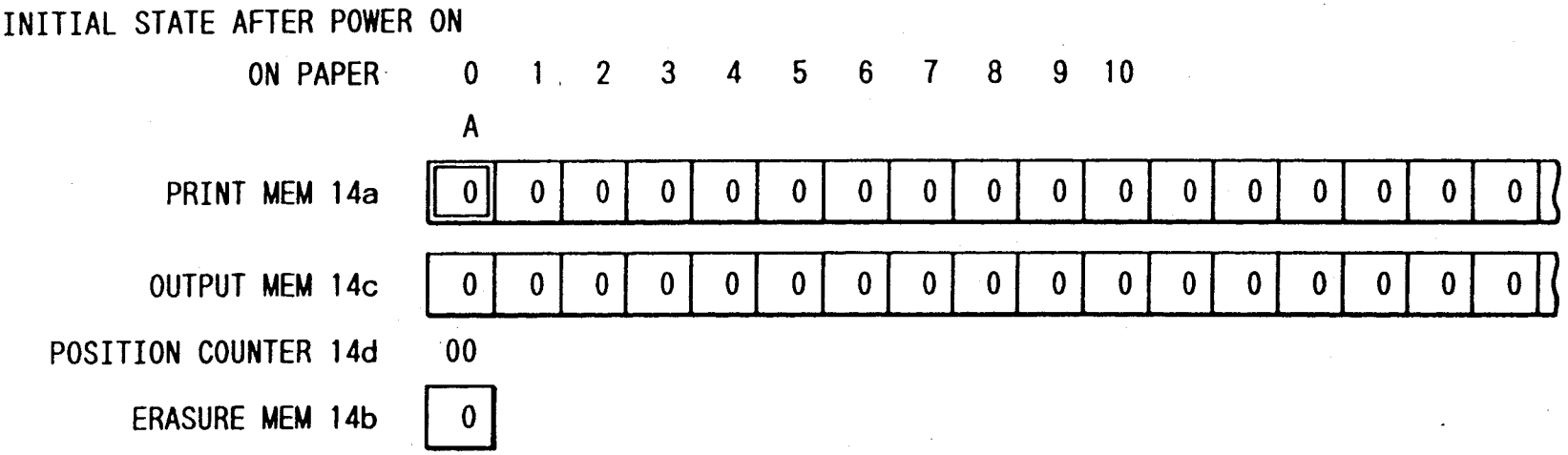
FIGS. 4A to 4C illustrate the automatic erasure processing according to this invention.
Figure 4B:
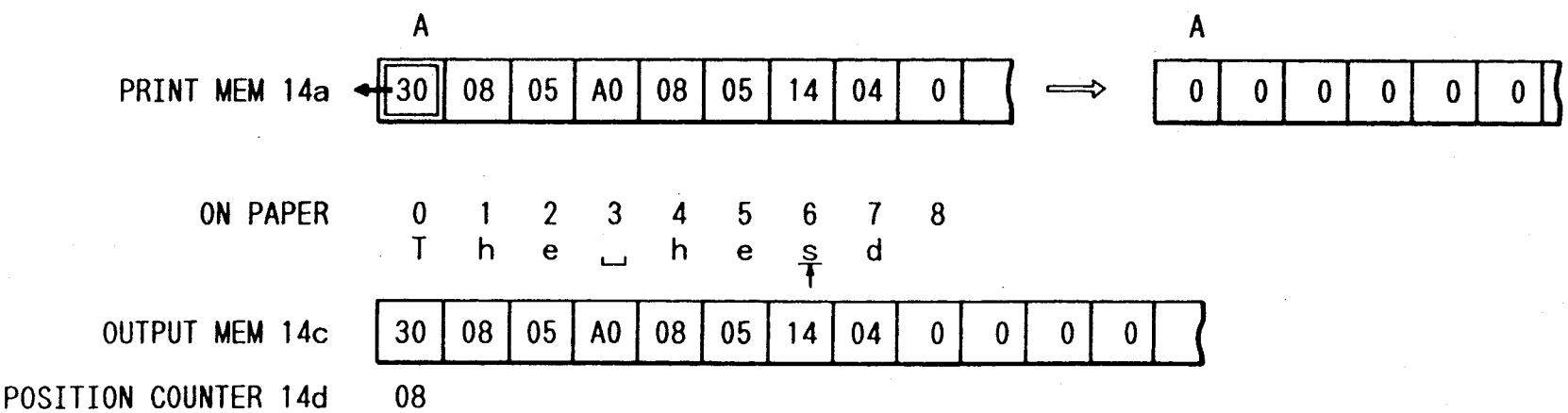
Figure 4C:
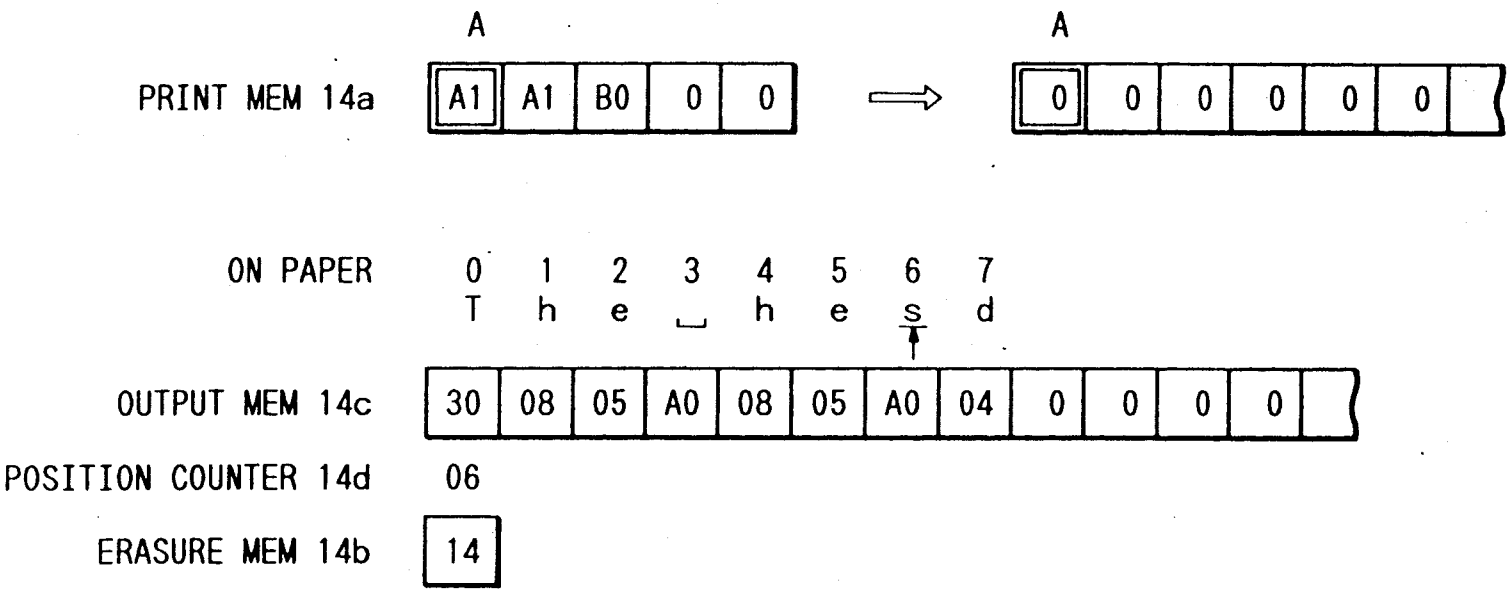

FIGS. 4A to 4C illustrate the processing in the automatic erasure mode according to this invention, with identical reference numbers being used for the elements similar to those shown in FIG. 2.

Figure 5A:
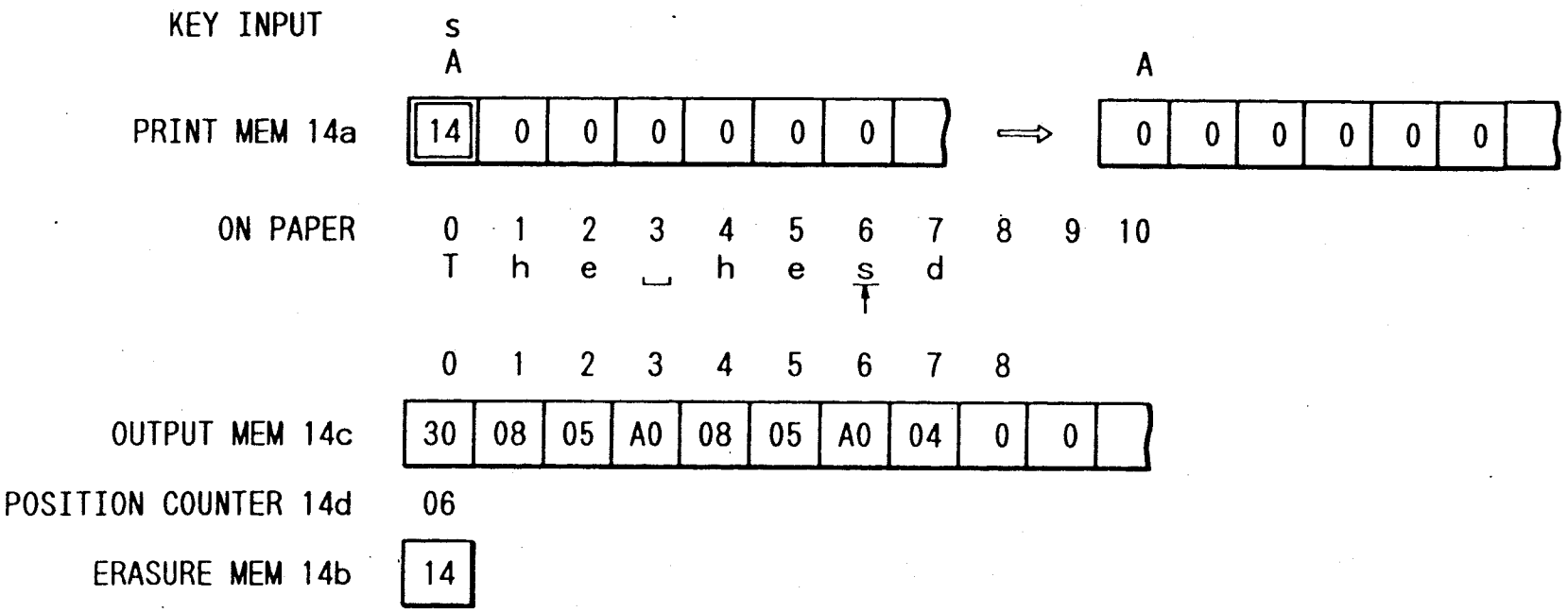
FIGS. 5A and 5B illustrate the continuous erasure processing according to this invention.
Figure 5B:
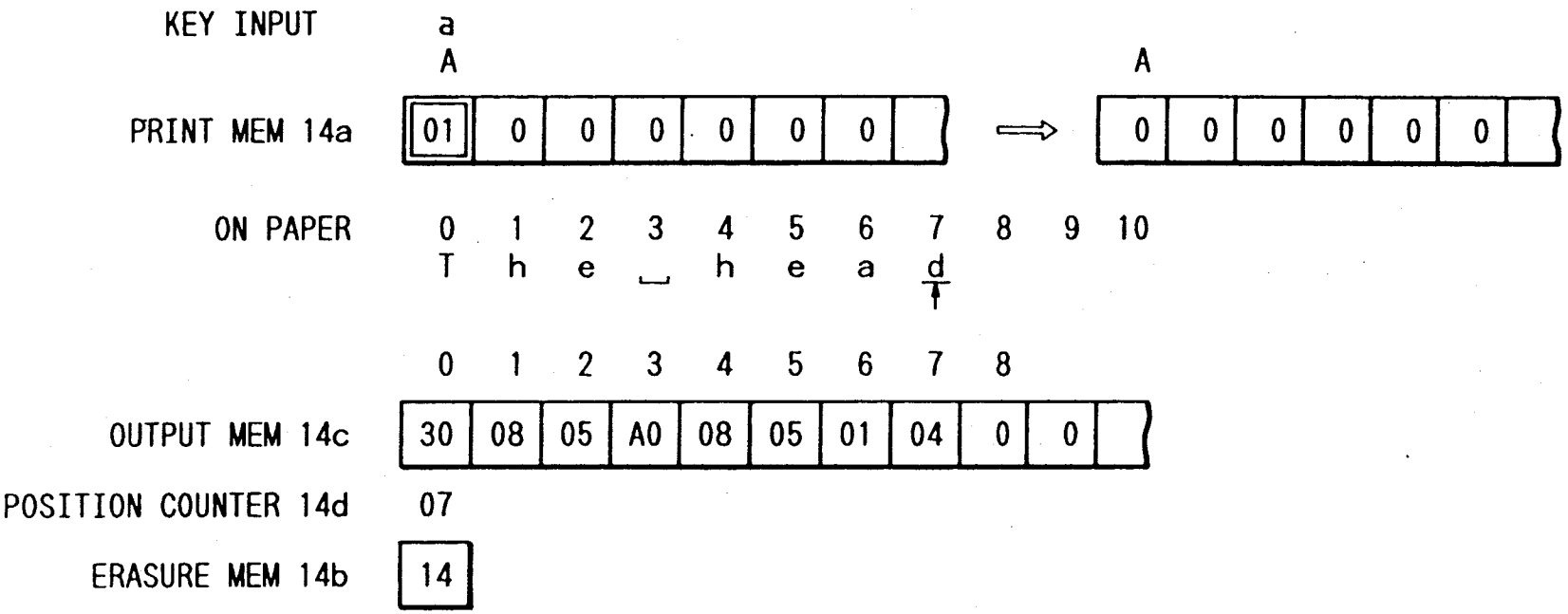

FIGS. 5A and 5B illustrate the processing in the continuous erasure operation according to this invention, with identical reference numbers being used for the elements similar to those shown in FIG. 2.

Figures 6, 6A:
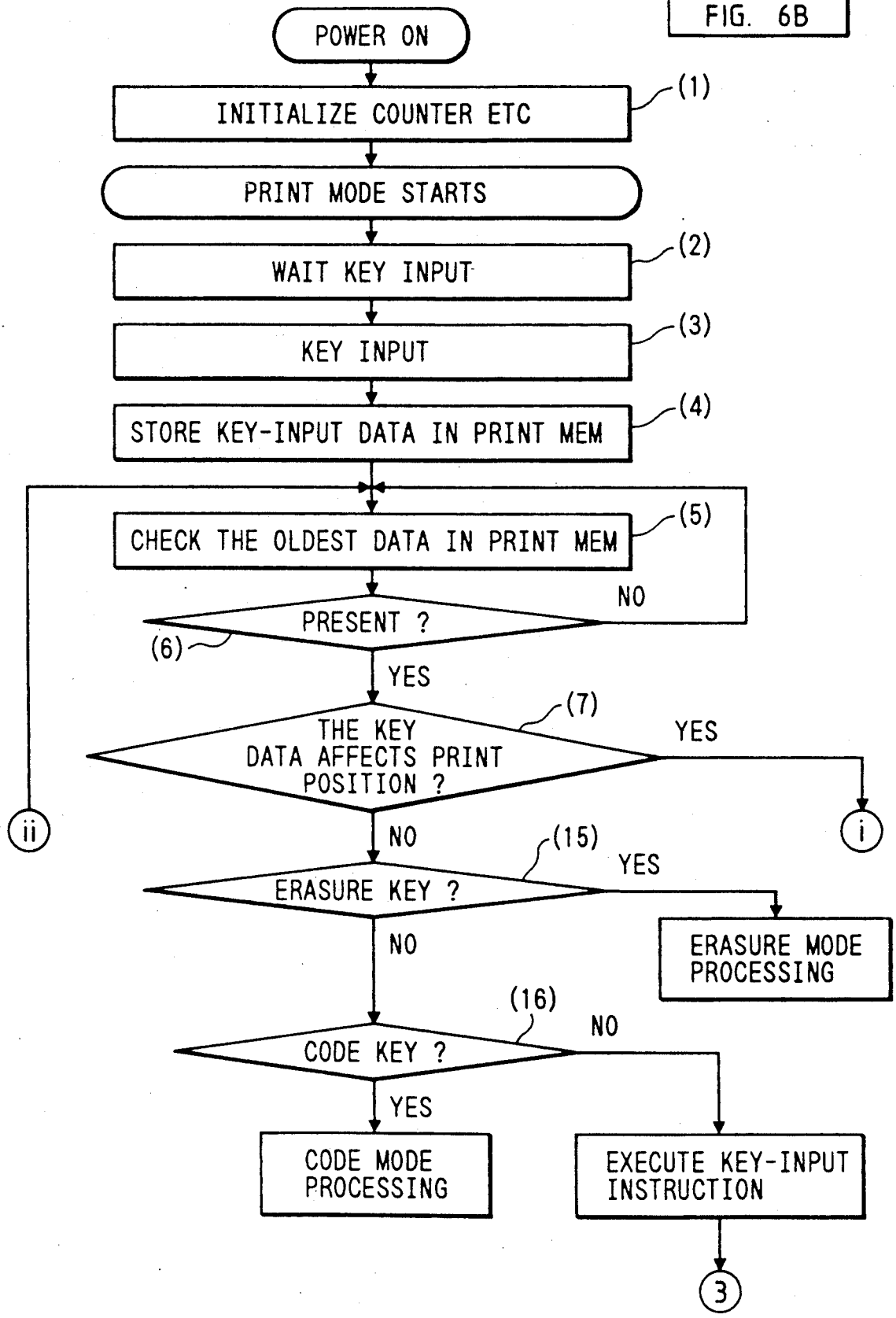
FIG. 6, consisting of FIGS. 6A and 6B, is a flow chart showing an example of a print processing procedure according to this invention.
Figure 6B:
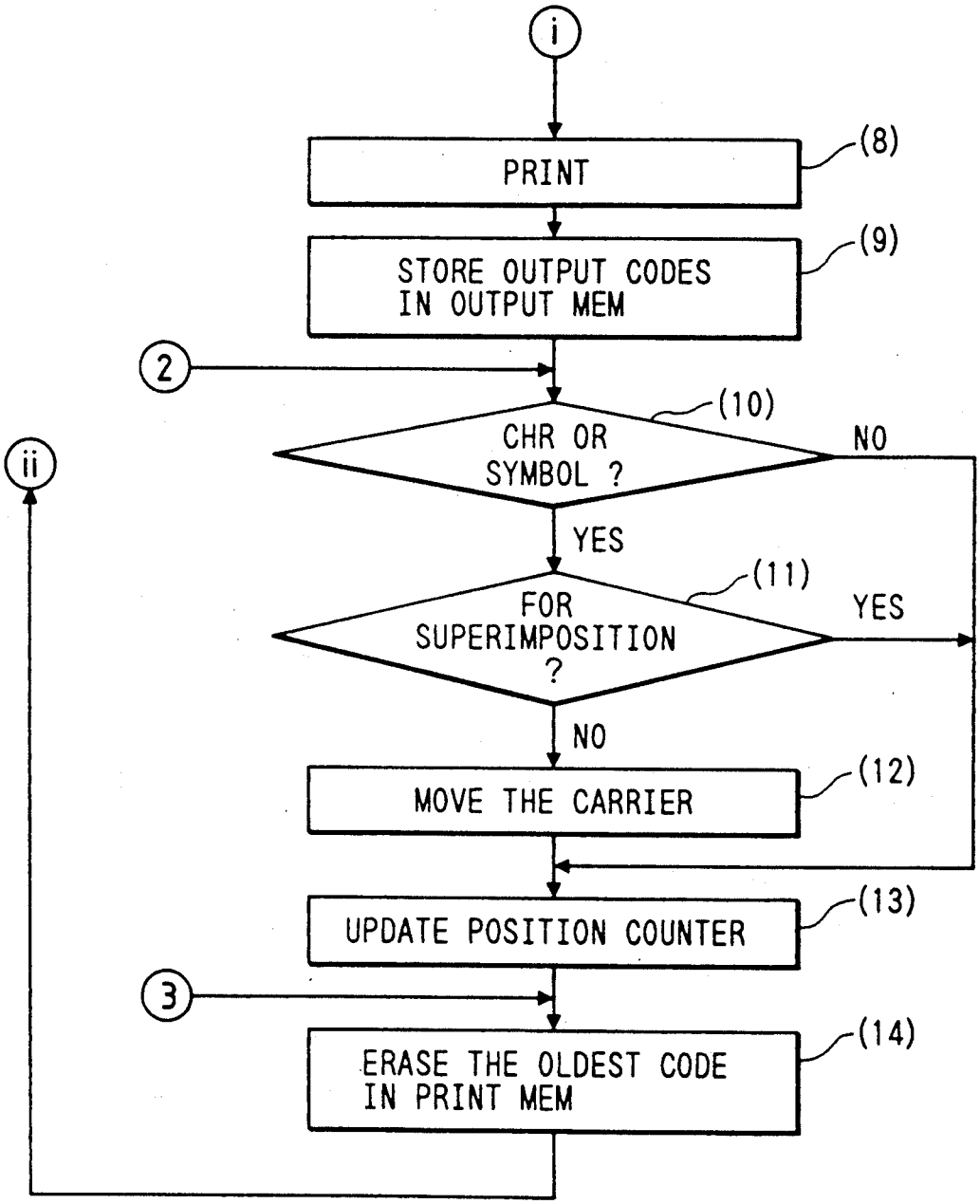

FIG. 6 is a flow chart showing an example of the processing procedure in the print mode according to this invention, the flow including steps 1 to 16, wherein it is assumed that a character at the position subject to correction is stored in the output memory 14c.

Referring to FIG. 4A, when the power is turned on, the contents in RAM 3 are initialized (step 1). Specifically, the contents of the print memory 14a, output memory 14c, position counter 14d and erasure memory 14b are all set to "0". This initial state corresponds to no key-input information from the keyboard 13. The present stop position of the print head 15a corresponds to the content "0" of the position counter 14d.

Next, the apparatus waits for a key input from the keyboard 13 (step 2). Upon a key input from the keyboard 13, the key-input data are sequentially stored in the print memory 14a as shown in FIG. 4B (step 4). The key memory 14a can store 30 characters or symbols for example. FIG. 4B shows the key-input data of "The hesd", the code of the key-input data being stored in the print memory 14a.

It is checked at step 5 if the oldest code information inputted from the keyboard 13 is stored in the print memory 14a. If NOT (step 6), the flow returns to step 5. If YES, it is checked if the oldest code information affects the position of the carrier holding the print head 15a, i.e., the print position (step 7). If YES (e.g., character, symbol, space or the like code affects the print position), the key-input information is outputted and printed out (step 8).

The code of the outputted and printed out character or symbol is stored in the output memory 14c (step 9).

Next, it is checked if the printed data is a character or a symbol (step 10). If NO, the flow advances to step 13. If YES, it is checked if the printed data is for a superimposing character (step 11). If YES, the flow advances to step 13. If NO, the carrier is moved by one space in the print direction (step 12). The value of a position counter is increased or decreased by the amount corresponding to a displacement of the carrier (step 13). Next, the oldest data stored in the print memory is deleted, i.e., the printed character data is deleted (step 14), and the flow returns to step 5.

Figures 7, 7A:
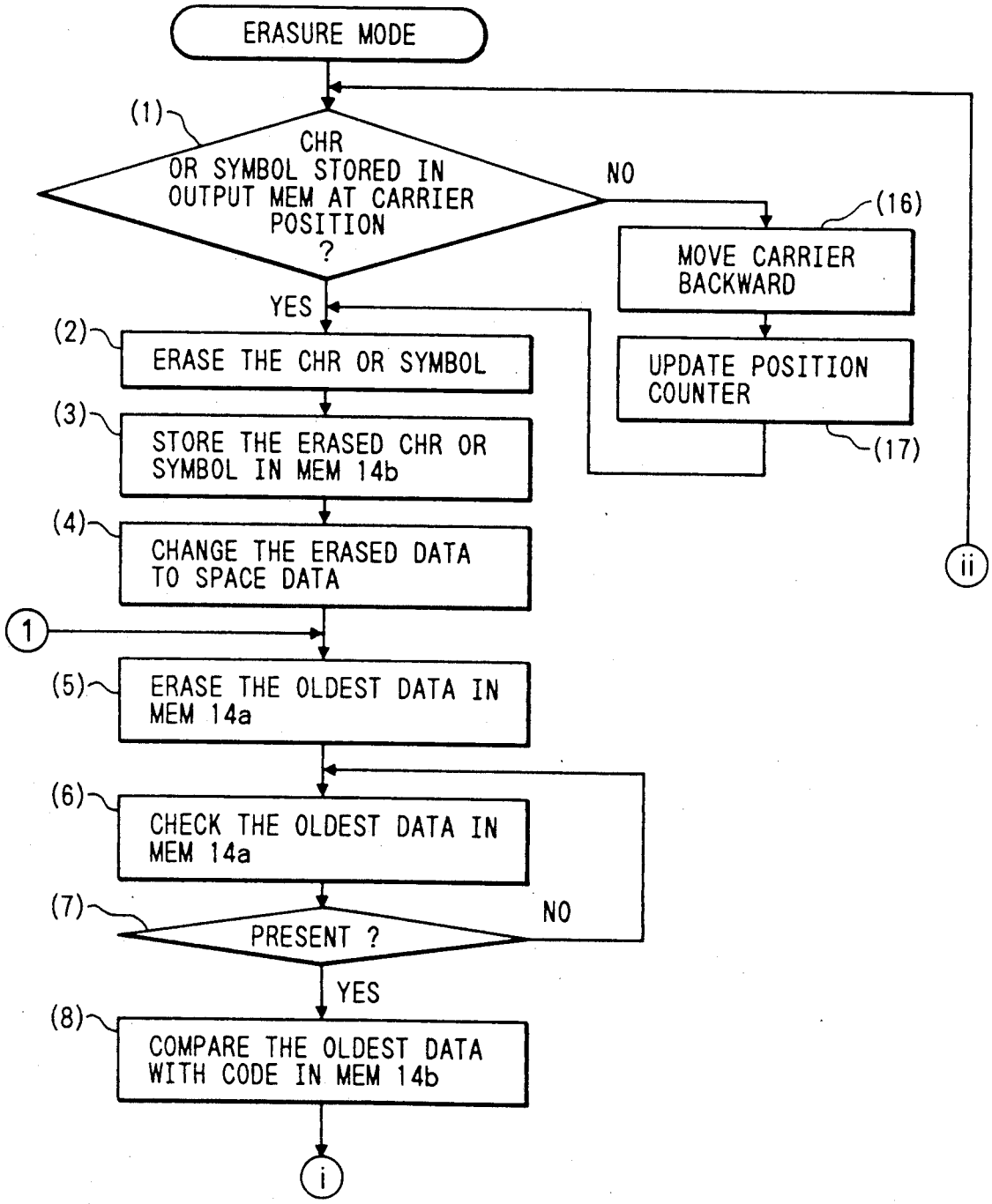
FIG. 7, consisting of FIGS. 7A and 7B, is a flow chart showing an example of the processing procedure in the erasure mode according to this invention.
Figure 7B:
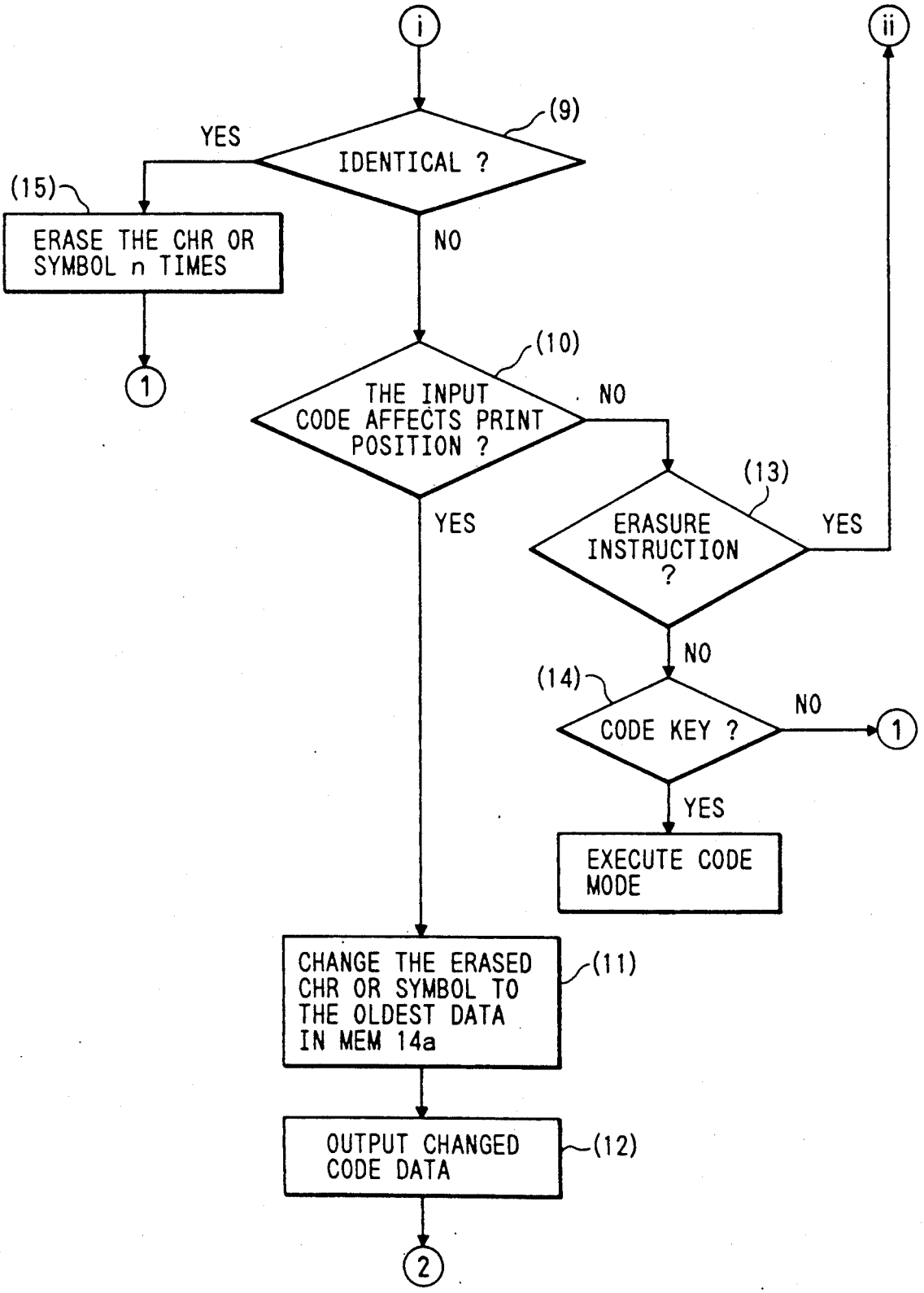

If NO at step 7, it is checked if the key data is for the erasure key 13b (step 15). If YES, the erasure mode processing shown in FIG. 7 is executed. If NO, it is checked if the key data is, for example, for a code key which affects the print position (step 16). If YES, the code mode processing is executed. If NO, the key-input instruction is executed and thereafter the flow returns to step 14.

In the above operations, as shown in FIG. 4B. the codes of the key-input data are sequentially stored in the print memory 14a. When the code stored at A shown in FIG. 4B is outputted, the data is shifted in the left. The new code at A is then checked in a similar manner. The outputted codes are sequentially stored in the output memory 14c, and at the same time the value of the position counter 14d is updated. The output data 14c can store 300 characters for example.

Next, the processing in the erasure mode entered upon an judgement of the key-input data as the erasure key 13b at step 15.

FIG. 7 is a flow chart showing an example of the processing procedure in the erasure mode according to this invention, the flowchart including steps 1 to 17.

In the erasure mode, it is checked if a character or symbol is stored in the output memory 14c at the carrier or print head 15a position (step 1). If YES, the character or symbol on the recording sheet at the carrier position is erased with the correction tape 15c (step 2). The code of the erased character of symbol is stored in the erasure memory 14b (step 3).

Next, the data in the output memory 14c for the erased character or symbol is changed to "space" code data (step 4) (refer to FIG. 4C). The printed oldest key data in the print memory 14a is deleted (step 5).

In the above operations, as shown in FIG. 4B, if an operator becomes aware that the character "s" was an error after key-inputting the data "The hesd", the back space key 13d is depressed two times to move backward the carrier at the sixth column. Thereafter, the erasure key 13b is depressed to erase the printed character "s". The code "14" for the character "s" is stored in the erasure memory 14b. The data in the output memory 14c for the erased character "s" is changed to a "space" code of "AO".

Next, it is checked if the oldest key data inputted from the keyboard 13 is stored in the print memory 14a (step 6). If NO (step 7), the flow returns to step 6 to wait for a key input.

If YES at step 7, the oldest key data stored in the print memory 14a is compared with the code data stored in the erasure memory 14b (step 8). It is checked if they coincide with each other (step 8). If YES, the flow advances to step 15 where the erasure operation for the same character or symbol at the same position is carried out, and thereafter the flow returns to step 5.

In the above manner, it becomes possible to repeat the erase operation with a simple key manipulation of depressing the key of a character or symbol to be erased, so long as the key-input code in the print memory 14a is coincident with the code stored in the erasure memory 14b.

Alternatively if NO at step 9, it is checked if the key-input data affects the print position (step 10). If YES, the data in the output memory 14c for the erased character or symbol at step 2 is changed to the oldest key data stored in the print memory 14a (step 11).

Next, the changed data in the output memory 14c is outputted and printed (step 12) and thereafter, the flow returns to step 10 shown in FIG. 6.

If NO at step 10, it is checked if the key-input data is the erasure instruction (step 13). If YES, the flow returns to step 1. If NO, it is checked if the key-input data from the keyboard 13 is a code key (step 14). If YES, a code mode is executed. If NO, the key-input instruction is executed and thereafter, the flow returns to step 5.

If NO at step 1, the carrier is moved backward to the position corresponding to the position nearest to the character or symbol stored in the output memory immediately before the present carrier position (step 16). The value of the position counter 14d is decreased by the amount corresponding to a displacement of the carrier (step 17), and the flow returns to step 2.

In the above operations, after perfectly erasing the character "s" in the printed data "The hesd" shown in FIG. 5A, a character "a" is key-inputted from the keyboard 13 as shown in FIG. 5B. The code "01" for the character "a" is stored in the print memory 14*a* at position A. Since the code previously stored in the erasure memory 14*b*, i.e., the code for the character "s" of "14", is different from the code "01" stored in the print memory 14*a* at position A, the flow advances to step 10 and to step 11 whereat the code data "14" of the erased character in the output memory 14*c* is changed to the code "01". Thereafter, the character "a" of the changed code data "01" is printed out on the recording sheet and thereafter the flow returns to the print mode. In the print mode as shown in FIG. 6, at step 12 and at the following steps, the carrier is moved one space in the print direction, the position counter is incremented by one, and the code "01" in the print memory 14*a* at position A is deleted, to thus complete a set of print and erasure modes. In this manner, the data in the erasure memory 14*b* is updated at any time when new data is input.

Next, another embodiment of this invention will be described with reference to FIG. 8.

Figures 8, 8A:
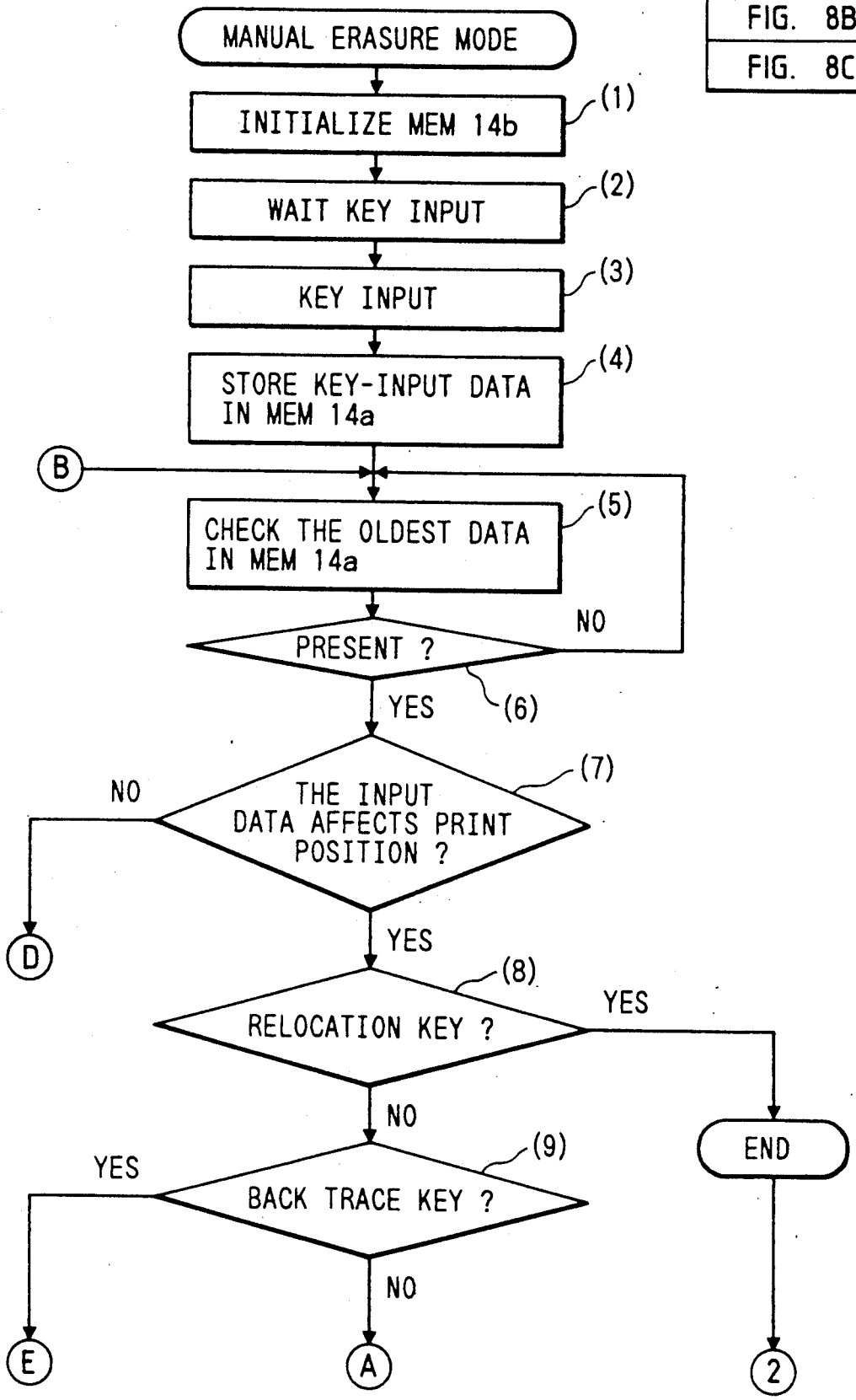
FIG. 8, consisting of FIGS. 8A, 8B and 8C, is a flow chart showing an example of the processing procedure in the manual erasure mode according to another embodiment of this invention.
Figure 8B:
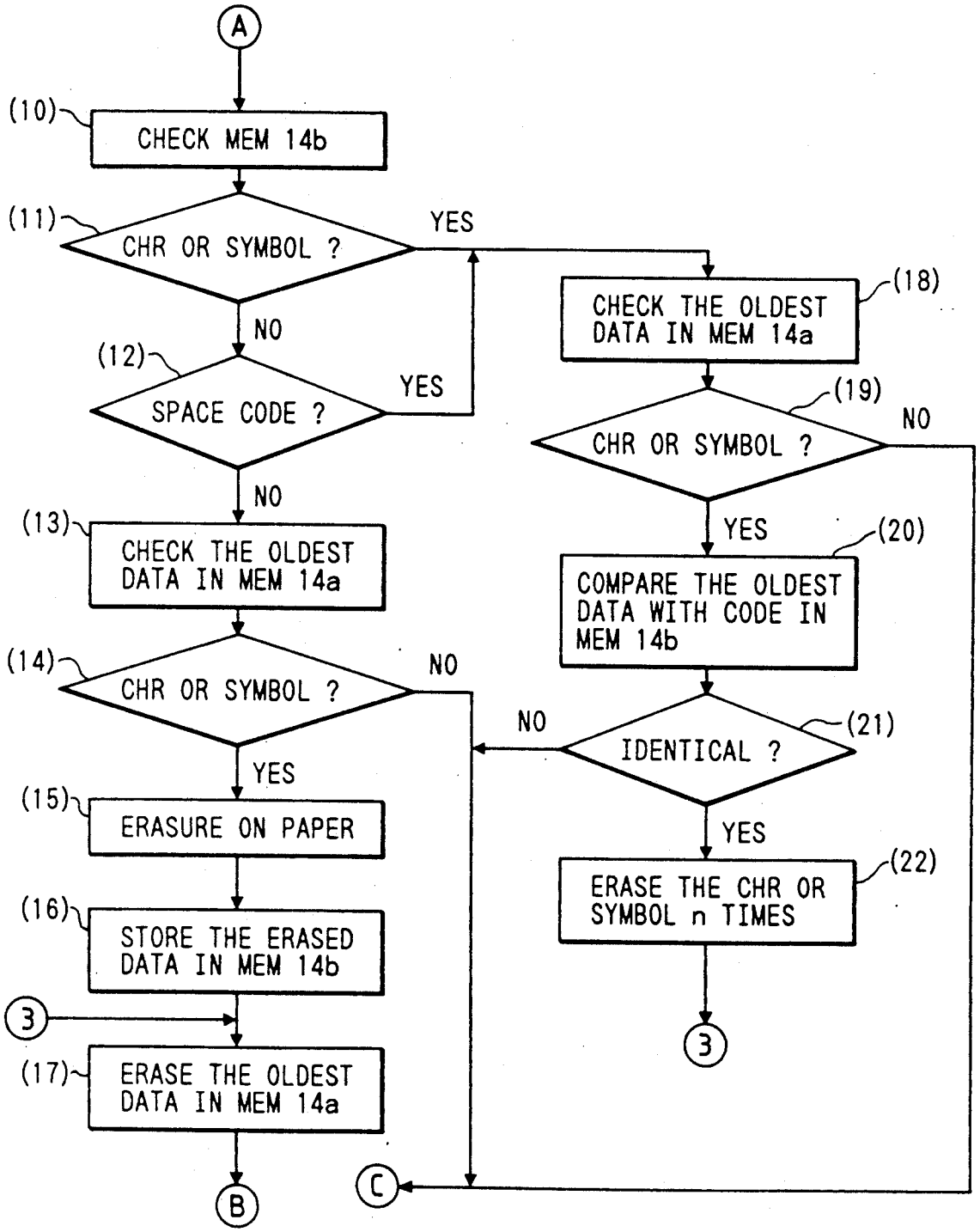
Figure 8C:
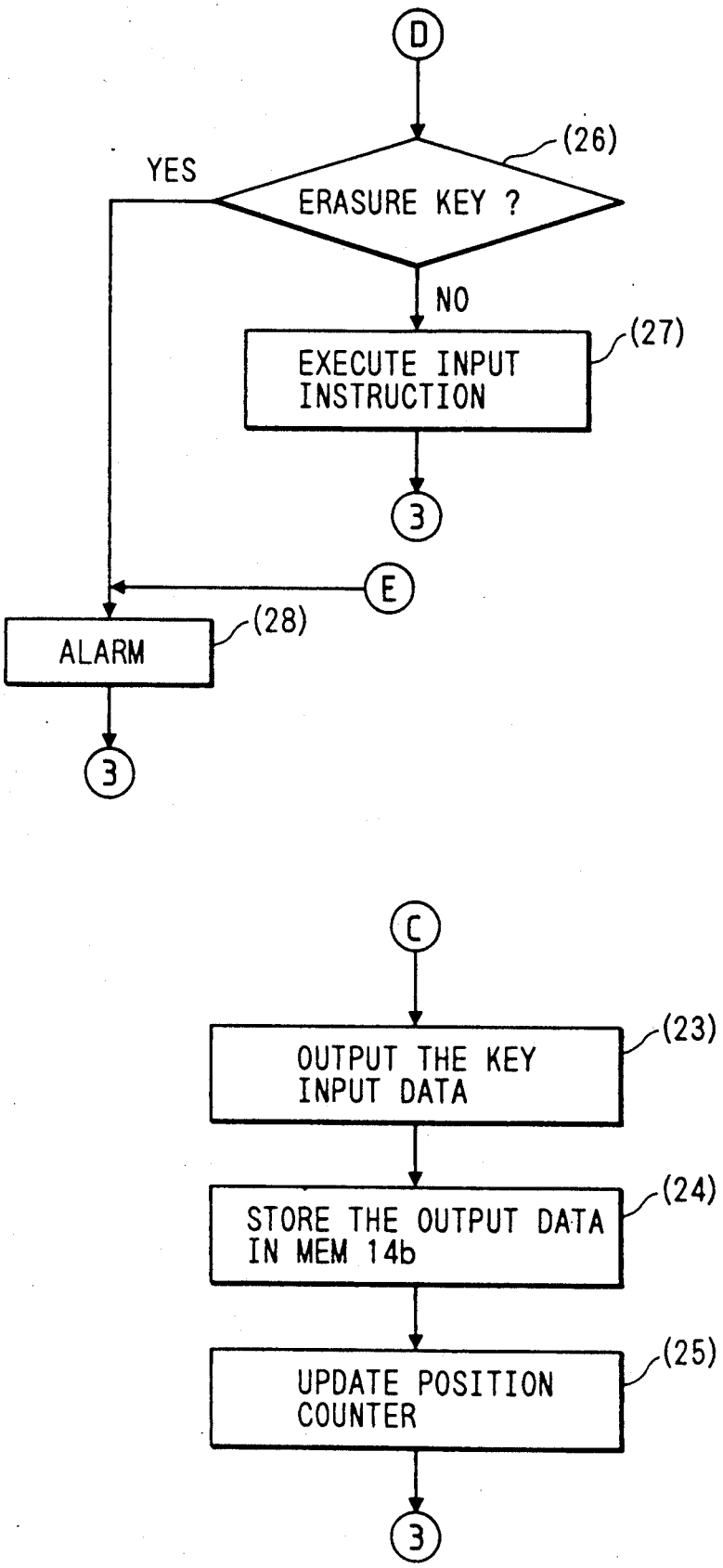
Figures 9, 9A:
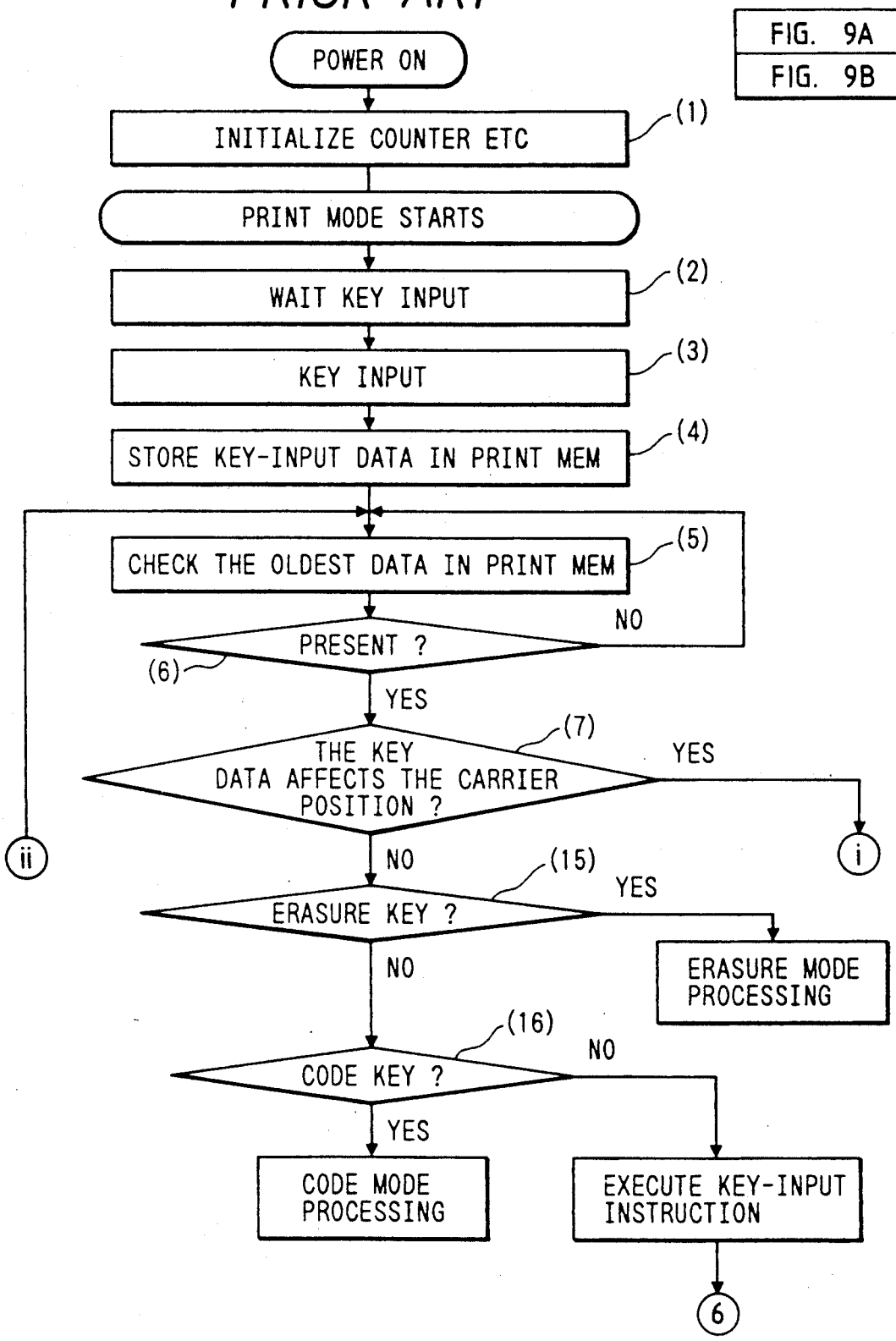
FIG. 9A PRIOR ART
FIG. 9 PRIOR ART
FIG. 9, consisting of FIGS. 9A and 9B, is a flow chart illustrating a conventional print control procedure.
Figure 9B:
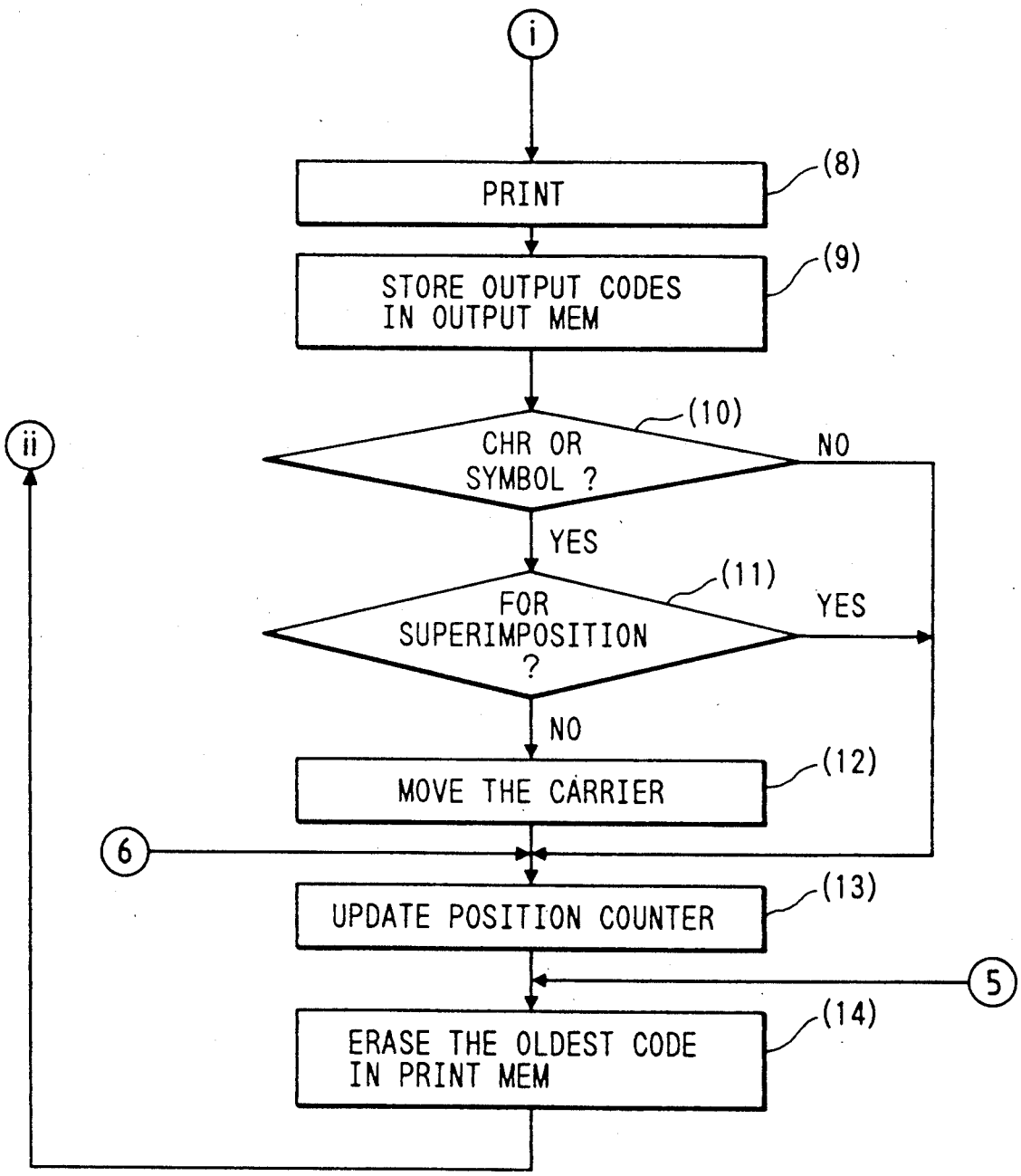
FIG. 9B PRIOR ART
Figure 10:
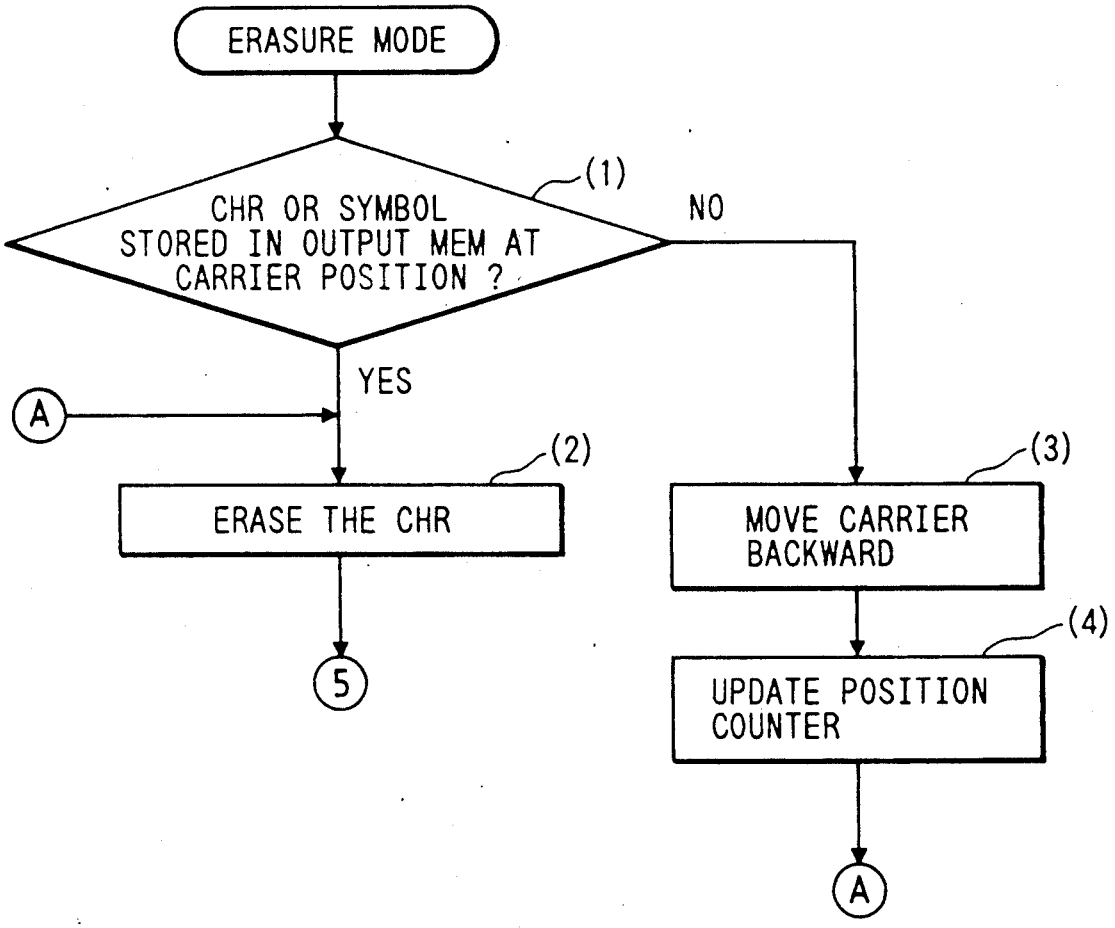
FIG. 10 PRIOR ART
FIG. 10 is a flow chart illustrating a conventional processing procedure in the erasure mode.
Figures 11, 11A:
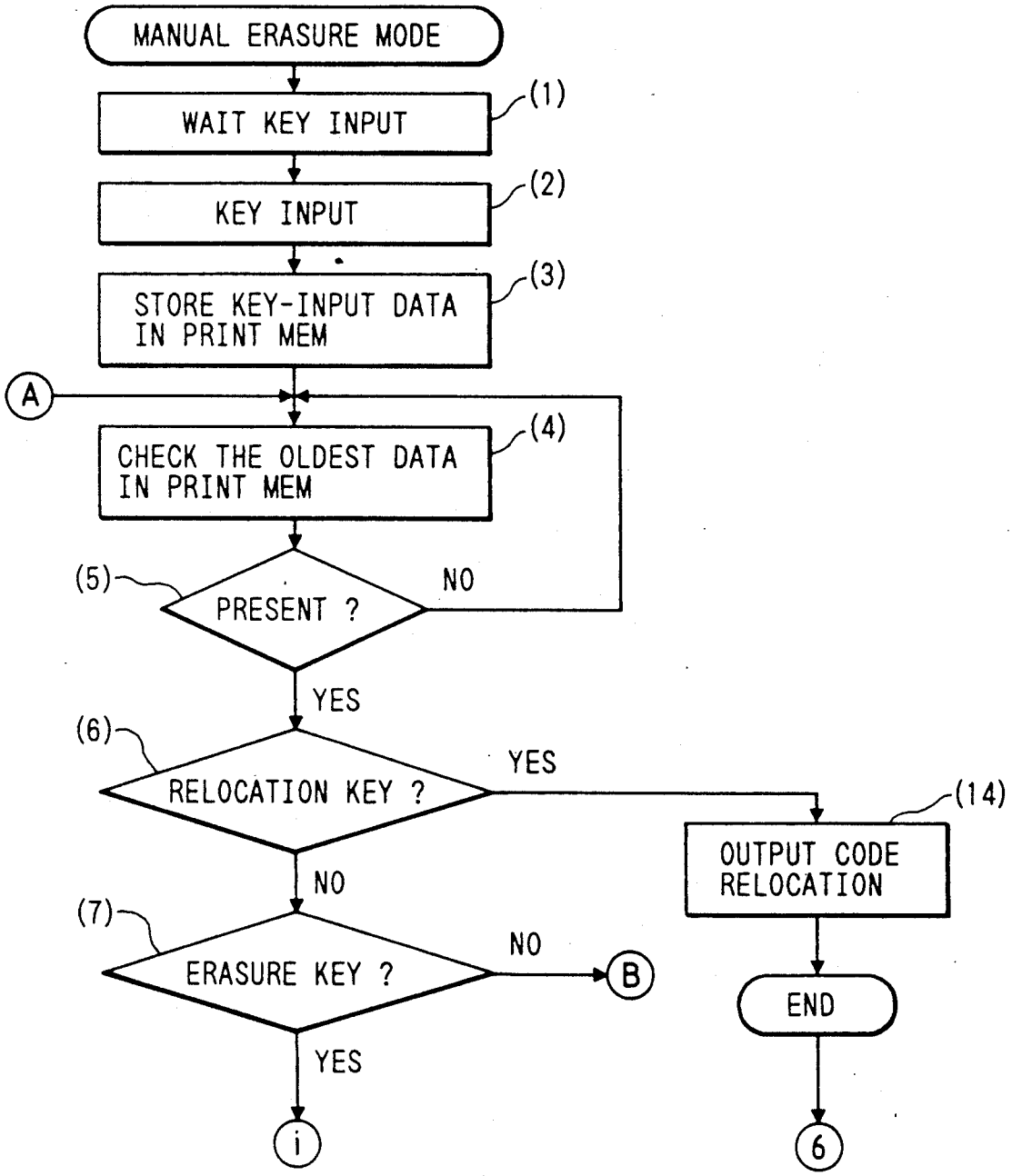
FIG. 11 PRIOR ART
FIG. 11A PRIOR ART
FIG. 11, consisting of FIGS. 11A and 11B, is a flow chart illustrating a conventional processing procedure in the manual erasure mode.
Figure 11B:
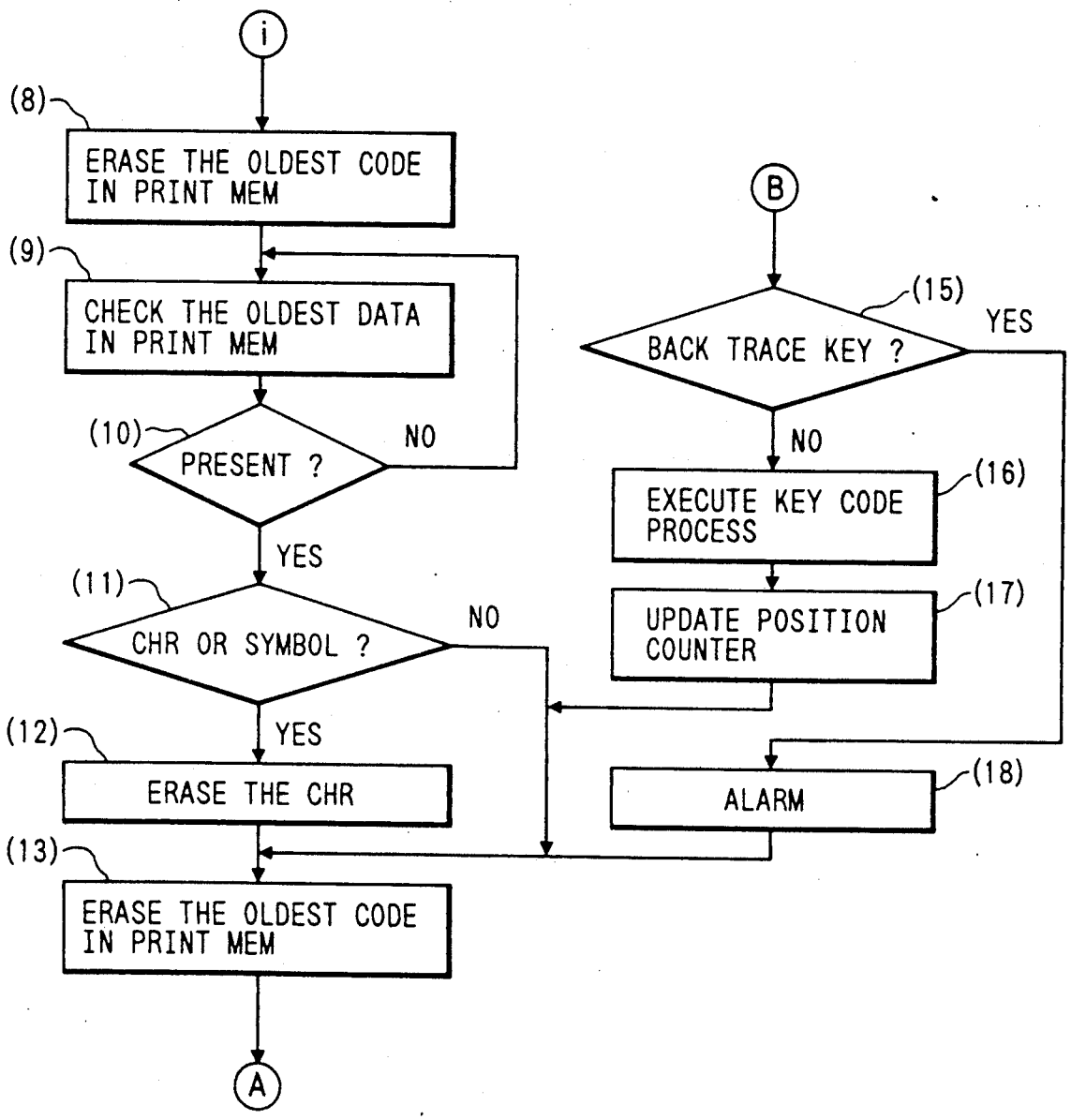
FIG. 11B PRIOR ART

FIG. 8 is a flow chart showing an example of the processing procedure in the manual erasure mode according to this embodiment, the flow including steps 1 to 28. The manual erasure mode is a mode wherein the key-input data of a character or symbol to be erased is not stored in the output memory 14*c* in a usual case.

Upon entering the manual erasure mode, the contents of the erasure memory 14*b* are initialized (step 1). Next, a key input from the keyboard 13 is waited (step 2). Upon a key input from the keyboard 13 (step 13), the key-input code is stored in the print memory 14*a* (step 4). It is checked if a key code inputted from the key board 13 is stored in the print memory 14*a* (step 5). If NO (step 6), the flow returns to step 5 to wait a key input. If YES, it is checked if the key-input information affects the print position, for example, it is checked if the information is for a character, symbol or space key (step 7). If YES, it is checked if there is a request for releasing the manual erasure mode, i.e., if the relocation key 13*a* is depressed (step 8). If YES, the manual erasure mode is terminated and the control is transferred to step 10 and the following steps shown in FIG. 6.

If NO at step 8, it is checked if the oldest key data stored in the print memory 14*a* corresponds to the back trace key 13*e* (step 9). If YES, the flow advances to step 28 and the following steps to notify an operator of the fact that any key input is not allowed at present, by means of a buzzer or the like. Thereafter, the control is transferred to step 17 and the following steps shown in FIG. 8.

If NO at step 9, the contents of the erasure memory 14*b* is checked (step 10) if they are for a character or symbol (step 11). If NO, it is checked if the contents are for a space code (step 12). If YES, the flow advances to step 18 and the following steps. If NO, it is checked if the oldest key data stored in the print memory 14*a* is for a character or not (step 14). If NO, the control advances to step 23 and the following steps. If YES, the erasure operation for the stored character or symbol is performed (step 15). The erased character or symbol information is stored in the erasure memory 14*b* (step 16), and the oldest key data in the print memory 14*a* is deleted to thereafter return to step 5.

If YES at step 11, the oldest key data stored in the print memory is again checked (step 18) if it is for a character or symbol (step 19). If NO, the flow advances to step 23 and the following steps. If YES, the oldest key code stored in the print memory 14*a* is compared with the code stored in the erasure memory 14*b* (step 20) to check if both codes are coincident with each other (step 21). If NO, the flow advances to step 23 and the following steps. If YES (if the character or symbol once erased, is to be erased again), the erasure operation for the once erased character or symbol is carried out n times (step 22) and thereafter the control is transferred to step 17 and the following steps shown in FIG. 8.

In the above operations, the character or symbol at the same print position can be erased as many times as the operator wishes by simply entering the character or symbol until the judgement at step 21 indicates a difference between both the codes.

If NO at step 19, the oldest key data stored in the print memory 14*a* is outputted and printed (step 23) and the outputted data is stored in the erasure memory 14*b* (step 24).

Next, if there is a displacement of the carrier, the value of the position counter 14*d* is increased or decreased by the amount corresponding to the displacement. Thereafter, the control is transferred to step 17 and the following steps shown in FIG. 8.

If NO at step 7 (if the oldest key data stored in the print memory 14*a* does not affect the print position, i.e., if the oldest key data is for the erasure key 13*b*, the mode key 13*f* or the like), it is checked if the key data is for the erasure key 13*b* (step 26). If YES, the flow advances to step 28 at which an alarm is generated to thereafter advance to step 17 and the following steps shown in FIG. 8.

If NO at step 26, an instruction entered by the mode key 13*f*, the code key 13*c* or the like is executed (step 27) and thereafter the control is transferred to step 17 and the following steps shown in FIG. 8.

As described so far, the printing apparatus of this invention comprises first storage means for storing key-input information; second storage means for storing information on a print object erased with an eraser; and erasure control means for controlling the eraser in accordance with a comparison result between the erased object information stored in the second storage means and the key-input information stored in the first storage means. Therefore, in the automatic erasure mode or manual erasure mode, the erasure operation for a character or symbol at the same carrier position can be carried out as many times as an operator wishes, by simply entering the same character or symbol is entered, to thus allow to perfectly erase the character or symbol with simple operator manipulation.

I claim:

1. A printing apparatus comprising:

a print mechanism for printing key-input print information on a recording medium;

erasing means for erasing a character or a symbol printed on the recording medium with said print mechanism;

first storage means for storing the key-input print information;

second storage means for storing information on a print object erased with said erasing means; and erasure control means for controlling said erasing means in accordance with a comparison between the erased object information stored in said second storage means and the key-input print information stored in said first storage means.

2. A printing apparatus comprising:

input means for inputting information to be printed;

erasing means for erasing printed information;
storage means for storing erased information;
means for determining if the information input from said input means is coincident with the information stored in said storage means; and
erasure control means for controlling said erasing means to again perform an erasure operation for said erased information, in accordance with the determination result by said determining means.

3. An apparatus according to claim 1, where said printing apparatus comprises a typewriter.

4. An apparatus according to claim 1, wherein said print mechanism comprises a correction sheet.

5. An apparatus according to claim 1, wherein said erasing means erases the character or symbol printed on the recording medium in response to receiving key-input information comprising information for instructing erasure of the character or symbol.

6. An apparatus according to claim 1, wherein said print mechanism comprises a carrier for mounting a print head thereon and means for controlling the position of said carrier.

7. An apparatus according to claim 6, wherein said erasing means ends its erasure operation in response to receiving key-input print information representing an instruction for moving said carrier.

8. An apparatus according to claim 1, wherein said print mechanism comprises a print sheet.

9. An apparatus according to claim 1, wherein said erasure control means controls said erasing means to erase the same character or symbol a plurality of times.

10. An apparatus according to claim 2, where said printing apparatus comprises a typewriter.

11. An apparatus according to claim 2, wherein said erasing means comprises a correction sheet.

12. An apparatus according to claim 2, wherein said input means inputs information for instructing erasure of a character or symbol.

13. An apparatus according to claim 2, further comprising a carrier for mounting a print head thereon and means for controlling the position of said carrier.

14. An apparatus according to claim 13, wherein said input means inputs information comprising information representing an instruction for moving said carrier, and wherein said erasing means ends its erasure operation in response to receiving the information representing an instruction for moving said carrier.

15. An apparatus according to claim 2, further comprising a print mechanism for printing information input by said input means, and wherein said print mechanism comprises a print sheet on which the inputted information is printed.

16. An apparatus according to claim 2, wherein said input means comprises a keyboard.

17. A method of printing and erasing printed material comprising the steps of:
printing print information on a recording medium which is key-input into a print mechanism;
erasing a character or symbol printed on the recording medium with the print mechanism;
storing the key-input print information;
storing information representing a print object erased in said erasing step;
comparing the information stored in said storing steps; and
controlling said erasing step in accordance with the results of said comparing step.

18. A method according to claim 17, wherein said printing step comprises the step of printing the print information with a typewriter.

19. A method according to claim 17, wherein said erasing step comprises the step of erasing the character or symbol with a correction sheet.

20. A method according to claim 17, wherein said erasing step comprises the step of erasing the character or symbol printed on the recording medium in response to receiving key-input information comprising information for instructing erasure of the character or symbol.

21. A method according to claim 17, wherein said printing step comprises the steps of printing print information on the recording medium with a print head mounted on a movable carrier, moving the movable carrier, and controlling the movement of the movable carrier.

22. A method according to claim 21, further comprising the steps of:
key-inputting information into the print mechanism representing an instruction to move the carrier; and
ending the erasing operation performed in said erasing step in response to receiving the information representing the instruction for moving the carrier in said key-inputting information step.

23. A method according to claim 17, wherein said printing step comprises the step of printing print information on the recording medium using a print sheet.

24. A method according to claim 17, wherein said controlling step comprises the step of controlling said erasing means to erase the same character or symbol a plurality of times.

25. A method for erasing printed information comprising the steps of:
inputting information to be printed into a printing apparatus;
performing an erasing operation on printed information printed by the printing apparatus;
storing the printed information on which the erasing operation was performed;
determining whether the information input in said inputting step is the same as the information stored in said stored step; and
performing another erasing operation on the printed information if said determining step determines that the information input in said inputting step is the same as the information stored in said storing step.

26. A method according to claim 25, wherein said inputting step comprises the step of inputting information to be printed into a typewriter.

27. A method according to claim 25, wherein said performing step comprises the step of performing an erasing operation on printed information with a correction sheet.

28. A method according to claim 25, further comprising the step of key-inputting into the printing apparatus information for instructing the performing of said erasure operation performing step on a printed character or symbol printed by the printing apparatus.

29. A method according to claim 25, further comprising the steps of printing print information on the recording medium with a print head mounted on a movable carrier, moving the movable carrier, and controlling the movement of the movable carrier.

30. A method according to claim 29, further comprising the steps of:

key-inputting information into the print mechanism representing an instruction to move the carrier; and ending the erasing operation performed in said erasing operation performing step in response to receiving the information representing the instruction for moving the carrier in said key-inputting information step.

31. A method according to claim 25, wherein said inputting step comprises the step of inputting information to be printed into the printing apparatus using a keyboard.

* * * * *

UNITED STATES PATENT AND TRADEMARK OFFICE

CERTIFICATE OF CORRECTION

PATENT NO. : 5,044,802

DATED : September 3, 1991

INVENTOR(S) : Noriyuki Sugiyama

It is certified that error appears in the above-identified patent and that said Letters Patent is hereby corrected as shown below:

COLUMN 3:

Line 34, change "FIGS. 3A" to -- FIG. 3A --; and

Line 36, change "FIG. 38" to -- FIG. 3B --.

COLUMN 5:

Line 60, change "FIG. 4B." to -- FIG. 4B, --;

Line 63, change "in" to -- to --; and

Line 67, change "output data 14c" to -- output memory 14c --.

UNITED STATES PATENT AND TRADEMARK OFFICE

CERTIFICATE OF CORRECTION

PATENT NO. : 5,044,802

DATED : September 3, 1991

INVENTOR(S) : Noriyuki Sugiyama

It is certified that error appears in the above-identified patent and that said Letters Patent is hereby corrected as shown below:

COLUMN 6:

Line 2, change "an judgement" to -- a judgement --;

Line 12, change "of symbol" to -- or symbol --; and

Line 27, change "AO" to -- A0 --.

COLUMN 7:

Line 30, change "waited" to -- awaited --;

Line 33, change "key" (second occurrence) to -- key- --; and

Line 35, change "wait" to -- await --.

UNITED STATES PATENT AND TRADEMARK OFFICE

CERTIFICATE OF CORRECTION

PATENT NO. : 5,044,802

DATED : September 3, 1991

INVENTOR(S) : Noriyuki Sugiyama

It is certified that error appears in the above-identified patent and that said Letters Patent is hereby corrected as shown below:

COLUMN 8:

Line 48, delete "is en-"; and

Line 49, delete "tered".

COLUMN 10:

Line 44, change "stored" to -- storing --.

Signed and Sealed this

Ninth Day of March, 1993

*Attest:*

STEPHEN G. KUNIN

*Attesting Officer*

*Acting Commissioner of Patents and Trademarks*